United States Patent [19]

Hagiwara

[11] Patent Number: 4,565,275

[45] Date of Patent: Jan. 21, 1986

[54] OPTOELECTRONIC COIN ENTRY SENSING SYSTEM FOR COIN OPERATED MACHINES

[75] Inventor: Takashi Hagiwara, Zama, Japan

[73] Assignee: Sigma Enterprises Incorporated, Tokyo, Japan

[21] Appl. No.: 560,192

[22] Filed: Dec. 12, 1983

[30] Foreign Application Priority Data

Dec. 15, 1982 [JP] Japan ..... 57-218328
Apr. 7, 1983 [JP] Japan ..... 58-59909

[51] Int. Cl.[4] ..... G07F 3/02
[52] U.S. Cl. ..... 194/97 R; 194/DIG. 15
[58] Field of Search ..... 194/97 R, 97 A, 97 B, 194/DIG. 15

[56] References Cited

U.S. PATENT DOCUMENTS 3,921,003 11/1975 Greene ..... 194/97 A

FOREIGN PATENT DOCUMENTS 3006893 9/1981 Fed. Rep. of Germany .... 194/97 R
0140600 10/1979 Japan ..... 194/97 R
8002081 10/1980 United Kingdom ..... 194/97 R

*Primary Examiner*—John J. Camby
*Attorney, Agent, or Firm*—Koda and Androlia

[57] ABSTRACT

For electronically sensing the proper entry of a coin into a slot machine, vending machine or the like, an upstanding chute extending from the slot of the machine has two pairs of opposed apertures formed therein. A coin falling through the chute successively intercepts light beams emitted by external light sources and normally falling on photodetectors through the apertures. The outputs from the photodetectors are used for measuring the period of time required for the coin to pass each pair of apertures and the period of time from the moment the coin starts passing the upper pair of apertures to the moment the coin completes passing the lower pair of apertures. The photodetector outputs are further utilized for detecting a reverse travel of the coin in the chute, as by the stringing of the coin by the customer. Additional embodiments provide for the detection of oversize and undersize coins from the photodetector outputs.

6 Claims, 13 Drawing Figures

OPTOELECTRONIC COIN ENTRY SENSING SYSTEM FOR COIN OPERATED MACHINES

BACKGROUND OF THE INVENTION

This invention pertains to a system for optoelectronically sensing the entry of coins into a coin operated machine such as a slot machine (gaming machine) or vending machine. The coin entry sensing system in accordance with the invention has provisions for sensing and thwarting a customer attempt to draw the coin out of the slot, among other features.

Conventional means for sensing coin entry into the slot of coin operated machines have been mostly mechanical or electromechanical. A long familiar one of such known means has been a microswitch having a feeler arm normally extending horizontally into the vertical path of the deposited coin. The falling coin engages and turns down the feeler arm, thus activating the microswitch. The resulting output signal of the microswitch represents the acceptance of a coin. The coin subsequently releases the feeler arm and allows the same to return to its normal position for sensing the entry of the next coin.

This conventional coin entry sensing mechanism is open to tampering. A typical tampering with coin operated machines is to hang a coin with string; the coin is dropped into the slot and, after activation of the microswitch, is drawn out of the slot. Difficulties have been encountered in mechanically sensing the upward movement of the coin.

The applicant is aware of a recent development employing photodetectors for sensing the downward travel of the deposited coin at proper speed, with a view to the prevention of illicit activities on the part of the customer. The prior art optoelectronic sensing system employs three photodetectors, however, together with complex circuitry and so is not so inexpensive as can be desired. As a further drawback it is incapable of detecting the reverse or upward travel of the coin.

Another frequent mode of tampering with coin operated machines is the use of different size coins or bored coins of smaller denominations than the required one. The advent of a sensing system that can make the coin operated machine immune to all such acts of tampering has long been awaited in the industry.

SUMMARY OF THE INVENTION

The present invention provides an optoelectronic coin entry sensing system of simplified and inexpensive organization capable of effectively making the coin operated machines proof against various possible acts of tampering or cheating.

The coin entry sensing system in accordance with the invention comprises guide means providing a coin guideway and having formed therein first and second pairs of opposed apertures spaced from each other in the longitudinal direction of the coin guideway. Disposed exteriorly of the guide means, first and second light sources normally irradiate first and second photodetectors through the first and second pairs of apertures, respectively. The deposited coin intercepts the light beams from the light sources while traveling past the apertures through the coin guideway. The sensing system further comprises first measuring means responsive to the first photodetector for measuring the period of time for the coin to traverse the first pair of apertures, second measuring means responsive to the second photodetector for measuring the period of time for the coin to traverse the second pair of apertures, and third measuring means responsive to both first and second photodetectors for measuring the period of time from the moment the coin starts passing the first pair of apertures to the moment the coin completes passing the second pair of apertures. In response to these measuring means, sensing means determine whether the three measured period of time are within predetermined limits. Also included is reverse motion detecting means which responds to both first and second photodetectors for detecting a reverse travel of the coin in the coin guideway.

When any of the three measured period of time exceeds an associated limit, the deposited coin has not traveled through the guideway at proper speed. Thereupon the sensing means puts out an OUT OF TIME signal which may cause the coin operated machine to reject the coin. In the event of a reverse or upward travel of the coin in the guideway (i.e. in a direction from the second to the first pair of apertures), that coin is obviously strung or being otherwise manipulated illicitly. Thus the reverse motion detecting means produces a REVERSE MOTION signal whereupon the machine may be locked up in an inoperable state and an alarm may be provided.

The coin entry sensing system in accordance with the invention can be further equipped to detect oversize or undersize coins. For the detection of oversize coins the spacing between the two pairs of apertures in the guide means may be made just slightly more than the diameter of the proper coin to be accepted by the machine. An oversize coin will then simultaneously intercept the light beams emitted by the two light sources. The resulting outputs from the photodetectors can be sensed as by an AND gate. For the detection of undersize coins, on the other hand, the spacing between the two pairs of apertures may be made only slightly less than the diameter of the proper coin. In this case an AND gate coupled to both photodetectors will provide a high output only when a proper size coin simultaneously intercepts the light beams from the two light sources.

It is to be appreciated that the inventive coin entry sensing system requires only two light sources and two associated photodetectors to perform the above recited functions. The system is therefore less costly and easier of manufacture than the prior art system employing three photodetectors.

The above and other features and advantages of the invention and the manner of attaining them will become more apparent, and the invention itself will best be understood, from a study of the following description and appended claims, taken together with the attached drawings showing some preferred embodiments of the invention.

DETAILED DESCRIPTION OF THE INVENTION

Figure 1:
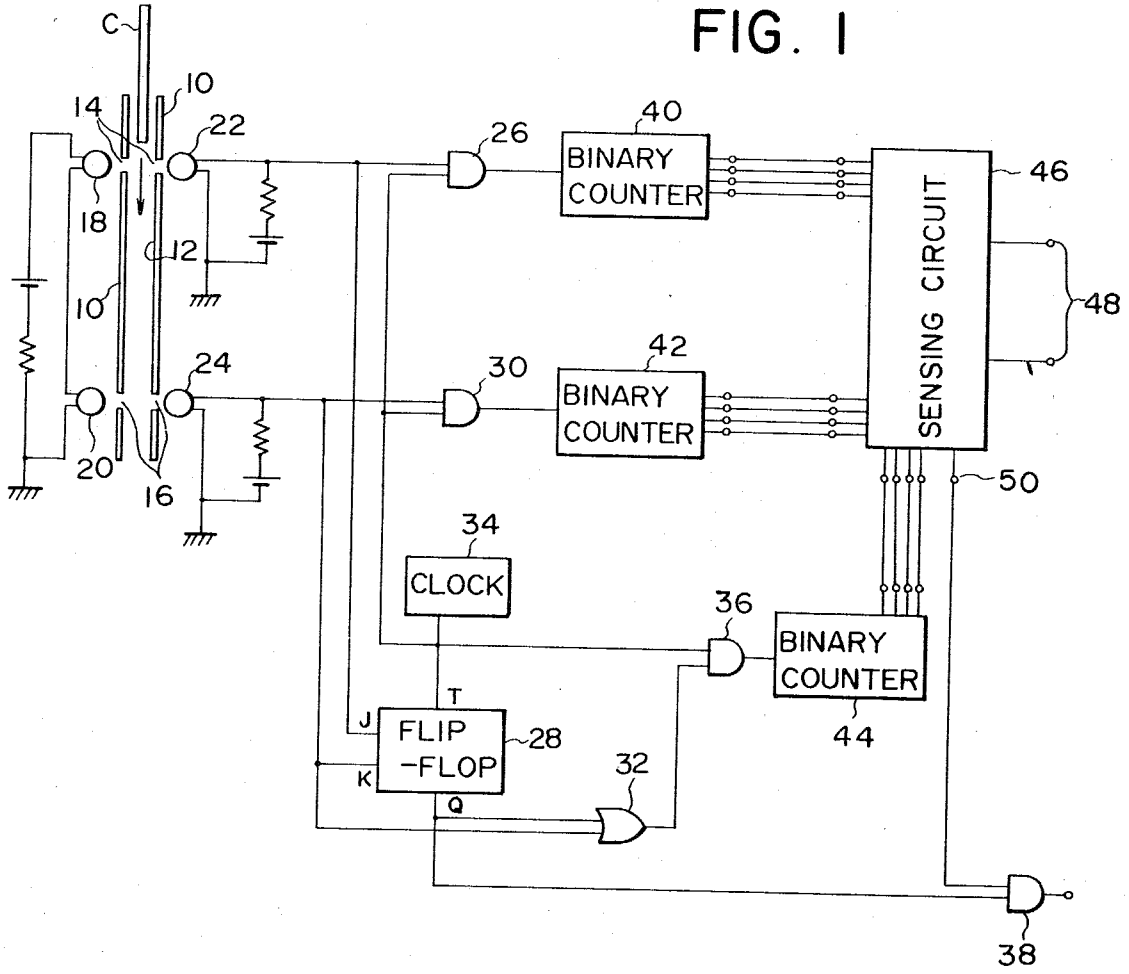
FIG. 1 is a block diagram of a first preferred form of the coin entry sensing system in accordance with the invention, the sensing system being herein shown adapted for the production of only OUT OF TIME and REVERSE MOTION signals.

The coin entry sensing system in accordance with the invention will now be described in detail in terms of its first preferred form shown in FIG. 1. The reference numeral 10 denotes a chute or like guide means defining a vertical coin guideway 12 through which a coin C is to fall on being inserted in the slot of the coin operated machine incorporating the sensing system. The chute 10 has formed therein a first or upper pair of apertures 14 opposed to each other across the coin guideway 12 and a second or lower pair of similar apertures 16. The spacing between the two pairs of apertures 14 and 16 is greater than the diameter of the valid coin C to be accepted by the machine in this particular embodiment.

Arranged exteriorly of the chute 10 and in the immediate vicinities of the two pairs of apertures 14 are two light sources 18 and 20 and two photodetectors 22 and 24. The upper light source 18 irradiates the upper photodetector 22 through the upper pair of apertures 14 whereas the lower light source 20 irradiates the lower photodetector 24 through the lower pair of apertures 16. The term "photodetectors" are herein used generically to denote any photoelectric devices that respond to radiant energy in one way or another. The particular photodetectors 22 and 24 employed in this embodiment are phototransistors whose outputs go high or low depending upon whether they are irradiated or unirradiated by the respective light sources 18 and 20. Of course, the phototransistors are normally irradiated by the light sources and are shielded therefrom as the falling coin C intervenes therebetween. Being less in diameter than the spacing between the two pairs of apertures 14 and 16, the coin C can intercept the beam of light from only one of the light sources 18 and 20 at one time. Such one by one interception of the light beams, however, is not an essential feature of the invention, as will become apparent from the additional embodiments of the invention to be presented subsequently.

The upper photodetector 22 has its output coupled to one of the two inputs of a first AND gate 26 and to the J input of a JK flip flop circuit 28. The lower photodetector 24 has an output coupled to one of the two inputs of a second AND gate 30, to the K input of the JK flip flop circuit 28, and to one of the two inputs of an OR gate 32.

A clock 34 is connected to the other inputs of the first and second AND gates 26 and 30 for the delivery of accurately timed pulses thereto. The clock 34 is further connected to the T input of the flip flop circuit 28 and to one of the two inputs of a third AND gate 36. The Q output of the flip flop circuit 28 is coupled to the other input of the OR gate 32 and to one of the two inputs of a fourth AND gate 38. The output of the OR gate 32 is coupled to the other input of the third AND gate 36.

The first, second and third AND gates 26, 30 and 36 have respective outputs coupled to first, second and third binary counters 40, 42 and 44 respectively. These counters count the clock pulses that have passed the respective AND gates 26, 30 and 36 and put on signals representative of the counts for delivery to a sensing circuit 46. It is the function of the sensing circuit 46 to determine from the input signals if the deposited coin C has fallen properly through the guideway 12. If it has not, then the sensing circuit 46 produces an OUT OF TIME signal from its output terminals 48. The sensing circuit 46 has another output terminal 50 coupled to the remaining one input of the fourth AND gate 38. A pulse is to be applied to the fourth AND gate 38 from the sensing circuit 46 immediately following the application of the counts to the latter from the three binary counters 40, 42 and 44.

The sensing circuit 46 and other pertinent parts of this coin entry sensing system may be integrally built into the electronic control circuitry of the coin operated machine.

OPERATION

Figure 2A:
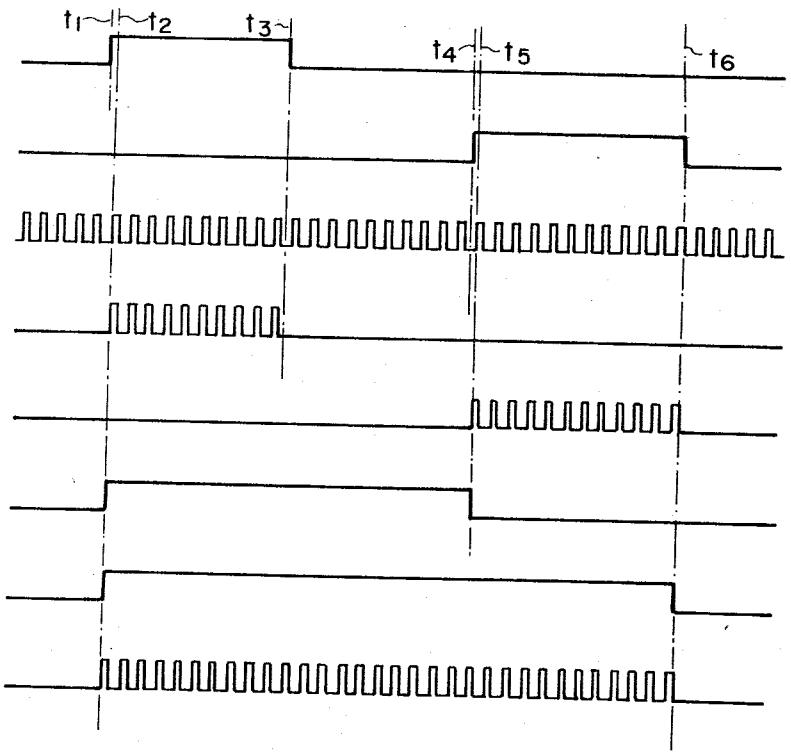
FIG. 2A is a waveform diagram showing signals appearing in various parts of the FIG. 1 system upon proper insertion of a coin.
Figure 2B:
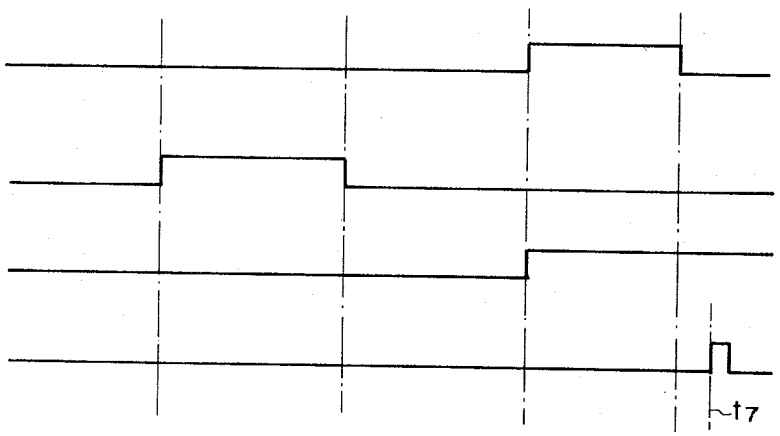
FIG. 2B is a waveform diagram showing signals appearing in various parts of the FIG. 1 system when a coin is reversed as by stringing.

The operation of the above coin entry sensing system will be best understood by referring to the waveform diagrams of FIGS. 2A and 2B. FIG. 2A is plotted on the assumption that the coin C has fallen through the guideway 12 without being reversed. FIG. 2B assumes that the reverse motion of the coin has taken place. Reference is first directed to FIG. 2A in order to discuss the normal operation of the system.

The coin C inserted in the slot of the machine reaches the upper apertures 14 in the chute 10 at a moment t1 in time. Before this moment, therefore, the beams of light emitted by the sources 18 and 20 impinges on the photodetectors 22 and 24. Consequently the outputs from the first and second AND gates 26 and 30, the JK flip flop circuit 28, and the OR gate 36 are all held low. The output pulses from the clock 34 are not applied to the binary counters 40, 42 and 44.

At the moment t1, when the coin C intercepts the light beam traveling from source 18 to photodetector 22 through the upper pair of apertures 14 in the chute 10, the output from the upper photodetector goes high. The high output from the upper photodetector 22 causes the first AND gate 26 to pass the clock pulses from the clock 34 toward the first binary counter 40 whereupon the latter starts counting the incoming pulses. The high output from the upper photodetector 22 is also delivered to the J input of the flip flop circuit 28. The Q output from this flip flop circuit goes high only when, at a subsequent moment t2, the first pulse delivered from the clock 34 after the moment t1 rises. The high Q output from the flip flop circuit 28 makes the output from the OR gate 32 go high, so that the third AND gate 32 allows the clock pulses to pass on to the third binary counter 44. Thus the third binary counter starts counting the clock pulses at the moment t2 immediately following the moment t1 when the coin C reaches the upper pair of apertures 14.

At the nest moment t3 the coin C just travels away from the upper pair of apertures 14, allowing the light beam from the source 18 to reirradiate the photodetector 22. As the output from the upper photodetector goes low, the first AND gate 26 blocks the passage of the clock pulses therethrough. The first binary counter 40 stops counting the clock pulses and delivers to the sensing circuit 46 the signal representative of the count which in turn indicates the period of time required for the deposited coin C to pass the upper pair of apertures 14.

Since the upper photodetector 22 is further coupled to the J input of the JK flip flop circuit 28, this input also becomes low at the moment t3. The Q output of the JK flip flop circuit 28 remains high, however. Consequently the output from the OR gate 32 also remains high, causing the third AND gate 36 to pass the clock pulses onto the third binary counter 44. The counting of the clock pulses by the third binary counter continues after the coin C has passed the upper pair of apertures 14.

The coin C reaches the lower pair of apertures 16 in the chute 10 at a moment t4. The interception of the light beam from the lower light source 20 causes the output from the lower photodetector 24 to go high. The high output from the lower photodetector 24 causes the second AND gate 30 to pass the clock pulses on to the second binary counter 42. This counter starts counting the clock pulses when the coin reaches the lower pair of apertures 16.

The high output from the lower photodetector 24 is also applied to the K input of the JK flip flop circuit 28. Accordingly, when the first pulse delivered from the clock 34 to the T input of the flip flop circuit after the moment t4 rises at a subsequent moment t5, its Q output goes low. The output from the OR gate 32 remains high, however, because the high output from the lower photodetector 24 is also applied directly to the OR gate 32. Receiving this high output from the OR gate 32, the third AND gate 36 continues passsing the clock pulses onto the third binary counter 44.

The coin C has just traveled past the lower pair of apertures 16 at a moment t6, so that the lower light source 20 resumes irradiating the lower photodetector 24. As the output from the lower photodetector 24 goes low, the second AND gate 30 discontinues passing the clock pulses on to the second binary counter 42 whereupon the latter stops counting the pulses. The count made by the second binary counter 42 represents the period of time required for the coin C to pass the lower pair of apertures 16. The low output from the lower photodetector 24 also causes the output from the OR gate 32 to go low since the signal applied to the other input of the OR gate from the Q output of the flip flop circuit 28 has been low from the moment t5. The low output from the OR gate 32 inhibits the passage of the clock pulses through the third AND gate 36. Thereupon the third binary counter 44 also stops counting the pulses at the moment t6. The third binary counter 44 thus obtains the count indicative of the period of time from the moment t1 (more exactly, moment t2) when the coin C starts passing the upper pair of apertures 14 to the moment t6 when the coin completes passing the lower pair of apertures 16.

Upon completion of counting the incoming clock pulses the three binary counters 40, 42 and 44 deliver their counts to the sensing circuit 46. The sensing circuit determines whether the received counts are within prescribed limits or not. If either of the counts exceeds the limit, the sensing circuit delivers the OUT OF TIME signal from its output terminals 48 to the control circuitry, not shown, of the coin operated machine.

The traveling speed of the coin through the chute 10 may decrease when the customer is attempting to draw the coin out of the slot as by stringing it. But this is not the sole reason for the reduction of coin speed. Additional reasons may be that the coin is rusty, or that some viscous matter such as sugary substances is attached to the coin. Accordingly the reduced traveling speed of the coin should per se be taken as no indication of some illegal activity on the part of the customer. From these considerations it is hereby suggested not to use the OUT OF TIME signal for locking the coin operated machine in a nonplayable, nondispensable, or otherwise inoperable condition, nor for the production of an alarm. Perhaps the best policy is to reject the coin and to let it fall into the tray constituting the part of the machine.

Upon receipt of the counts from all the binary counters 40, 42 and 44 the sensing circuit 46 puts out a pulse at a moment t7, FIG. 2B, from its terminal 50 for delivery to the fourth AND gate 38. This fourth AND gate does, or does not, pass the received pulse as a REVERSE MOTION signal depending upon whether the coin has traveled straight down the chute 10 or has been reversed. A comparative study of FIGS. 2A and 2B will make it clear why the output from the AND gate 38 depends upon whether the coin has been reversed or not. If the coin has traveled down the chute 10 without being reversed, the Q output of the JK flip flop circuit 28 has been low since the moment t5 immediately following the moment t4 when the coin reaches the lower pair of apertures 16, as indicated in FIG. 2A. Consequently the pulse delivered from the sensing circuit 46 at the moment t7 does not pass the fourth AND gate 38. FIG. 2B plots the J and K inputs and Q output of the JK flip flop circuit 28 when the coin is reversed. It will be noted from this figure that the Q output of the flip flop circuit has been high since the moment the coin has reached the upper pair of apertures 14 on its reverse travel. This high output enables the output pulse of the sensing circuit 46 to pass the fourth AND gate 38 as the REVERSE MOTION signal for application to the control circuitry of the coin operated machine.

The REVERSE MOTION signal is an unerring token of an illicit action, usually the stringing of the coin, on the part of the customer. On receipt of this signal, therefore, the control circuitry may lock the machine in an inoperable condition and/or may provide an alarm. If the machine is furnished with a display such as that comprising a cathode ray tube, a suitable indication such as "COIN IS REVERSED" may be exhibited thereon by way of a warning.

SECOND FORM

Figure 3:
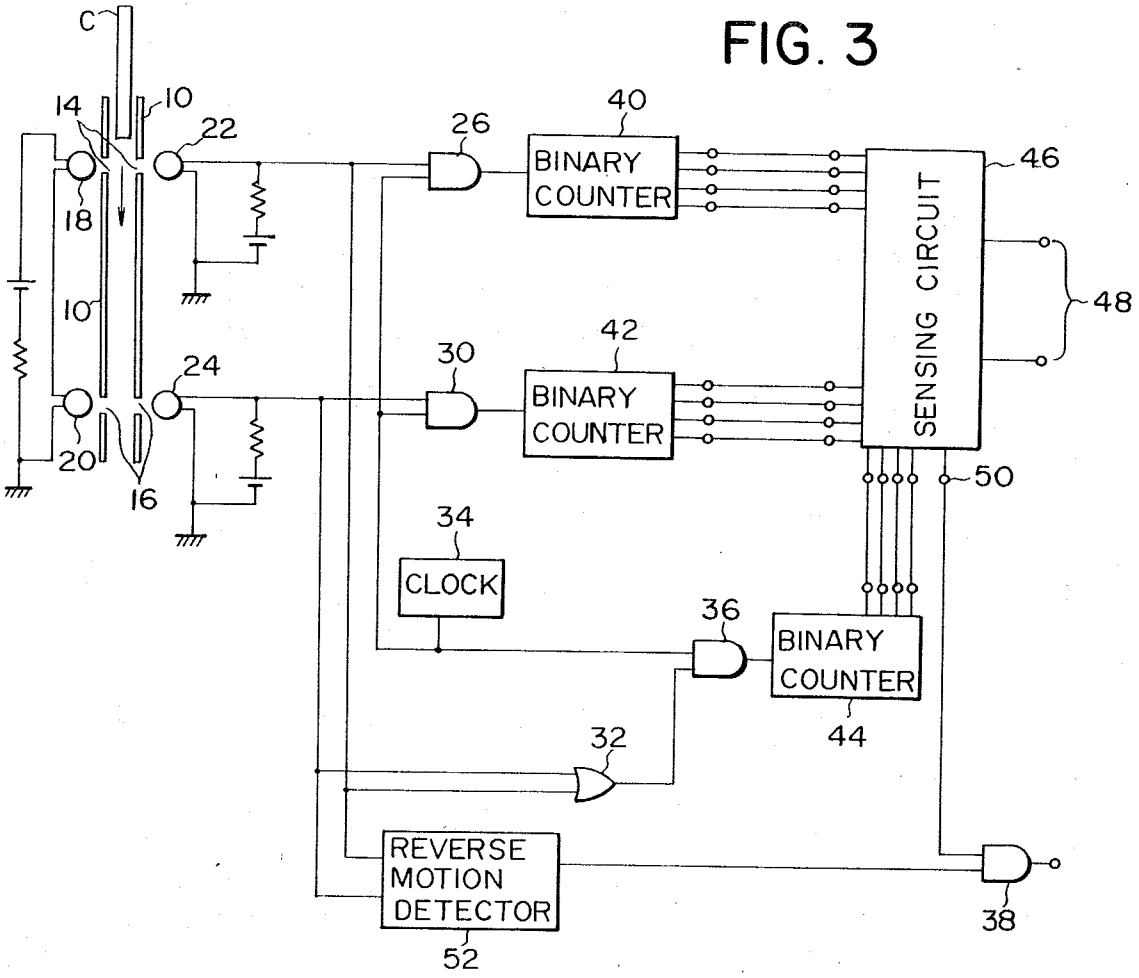
FIG. 3 is a block diagram of a second preferred form of the coin entry sensing system in accordance with the invention, the sensing system incorporating different means for the production of the REVERSE MOTION signal.

FIG. 3 shows another preferred form of the coin entry sensing system in accordance with the invention, which incorporates some modifications of the FIG. 1 system. One of the modifications is that the spacing between the two pairs of apertures 14 and 16 in the chute 10 is made less than the diameter of the proper coin C which is accepted by the machine. A coin sorter of any suitable design may be provided upstream of the chute 10.

Another modification is the elimination of the JK flip flop circuit 28; instead, a reverse motion detector 52 is provided which has two inputs coupled directly to the two photodetectors 22 and 24 respectively. The output of the reverse motion detector 52 is coupled to the fourth AND gate 38. Comprised of standard electronic devices such as flip flops and diodes, the reverse motion detector 52 has its output inverted in response to the inputs from the photodetectors 22 and 24 in a manner to be described in the subsequent description of operation.

As the JK flip flop circuit 28 has been eliminated as aforesaid, the OR gate 36 has its two inputs coupled directly to the two photodetectors 22 and 24 respectively. Its output is coupled to the third AND gate 36 as in the preceding embodiment.

The other details of configuration are as set forth previously in connection with FIG. 1. The various parts of this coin entry sensing system, with the exception of the newly introduced reverse motion detector 52, will therefore be identified by the same reference numerals as used to designate the corresponding parts of the FIG. 1 system.

OPERATION OF SECOND FORM

Figure 4A:
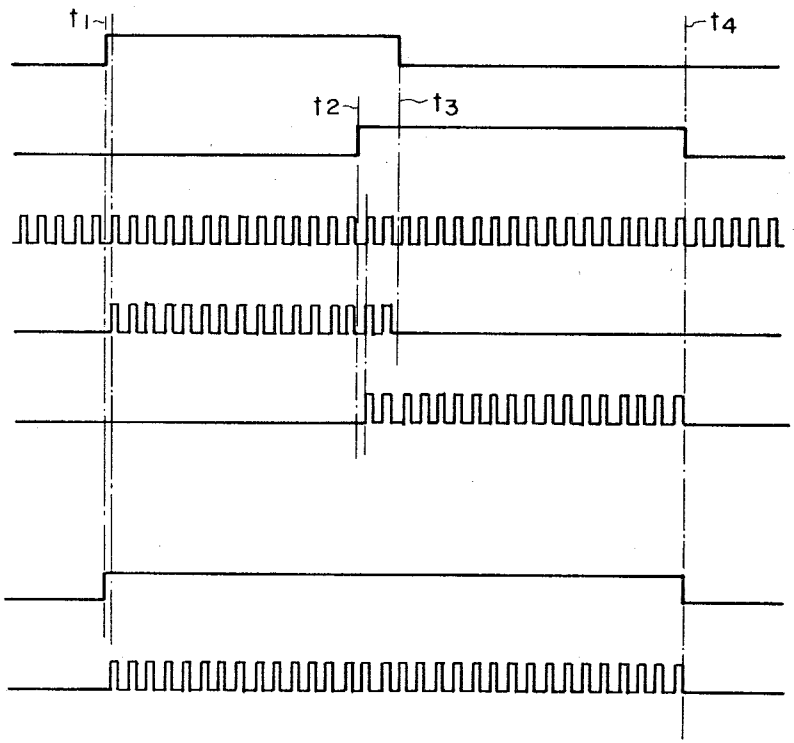
FIG. 4A is a waveform diagram showing signals appearing in various parts of the FIG. 3 system upon proper insertion of a coin.

FIG. 4A is explanatory of the operation of the FIG. 3 system, plotted on the assumption that the coin C of proper denomination has fallen properly through the chute 10. Before the deposited coin C reaches the upper pair of apertures 14 in the chute 10 at a moment t1 in time, the output from both photodetectors 22 and 24 are low, so that the AND gates 26, 30 and 36 do not pass the clock pulses on to the binary counters 40, 42 and 44.

At the moment t1, when the coin blocks the light beam from the upper light source 18, the output from the upper photodetector 22 goes high and so allows the first AND gate 26 to pass the clock pulses onto the first binary counter 40. The high output from the upper photodetector 22 is also directed to the OR gate 32. The resulting high output from this OR gate causes the third AND gate 36 to pass the clock pulses onto the third binary counter 44. Thus both first 40 and third 44 counters start counting the clock pulses when the coin starts passing the upper pair of apertures 14 in the chute 10.

The leading edge of the coin C reaches the lower lower pair of apertures 16 at a moment t2, intercepting the light beam from the lower light source 20. As the output from the lower photodetector 24 goes high as a consequence, the second AND gate 30 allows the passage of the clock pulses therethrough. Thereupon the second binary counter 42 starts counting the clock pulses. As has been stated, the diameter of the coin C is greater than the spacing between the two pairs of paertures 14 and 16 in the chute 10. At the moment t2, therefore, the coin still blocks the light beam from the upper light source 18, so that the output from the upper photodetector 22 is still high. The output from the OR gate 32 remains high, causing the third AND gate 36 to continue passing the clock pulses to be counted by the third binary counter 44.

The trailing edge of the coin C travels away from the upper pair of apertures 14 at a moment t3. As the light beam from the upper light source 18 falls again on the upper photodetector 22, its output goes low and so causes the first AND gate 26 to prevent the passage of the clock pulses therethrough. The first binary counter 40 stops counting the pulses and delivers to the sensing circuit 46 the count representative of the period of time for the coin to pass the upper pair of apertures 14. One of the inputs to the OR gate 32 also goes low at the moment t3. However, since the other input to this OR gate has been high from the preceding moment t2, its output remains high. The third AND gate 36 continues passing the clock pulses to be counted by the third binary counter 44.

The trailing edge of the coin C travels away from the lower pair of apertures 16 at a moment t4. The light beam from the lower light source 20 again falls on the lower photodetector 24. The resulting low output from this photodetector causes the second AND gate 30 to block the passage of the clock pulses therethrough. The second binary counter 42 stops counting the pulses and delivers to the sensing circuit 46 the count representative of the period of time required for the coin to pass the lower pair of apertures 16. The low output from the lower photodetector 24 also affects the OR gate 32. As the other input to this OR gate has been low since the moment t3, its output goes low. Accordingly the third AND gate 36 stops passing the clock pulses whereupon the third binary counter 44 delivers to the sensing circuit 46 the count corresponding to the period of time from the moment t1 the coin starts passing the upper pair of apertures 14 to the moment t4 the coin completes passing the lower pair of apertures 16.

As in the preceding embodiment the sensing circuit 46 puts out an OUT OF TIME signal from its output terminals 48 when any of the received counts exceeds a predetermined limits. The production of the OUT OF TIME signal may result in a mere rejection of the coin for the reasons set forth in conjunction with the preceding embodiment.

Figure 4B:
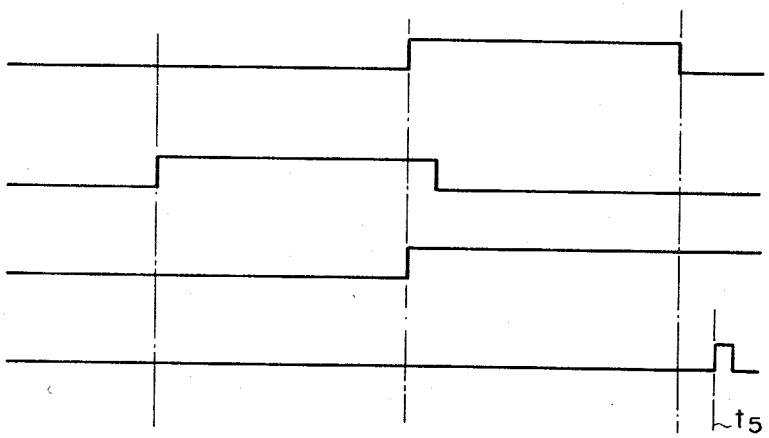
FIG. 4B is a waveform diagram showing signals appearing in various parts of the FIG. 3 system when a coin is reversed as by stringing.

Upon receipt of the counts from all the binary counters 40, 42 and 44 the sensing circuit delivers a pulse to one of the inputs of the fourth AND gate 38 at a moment t5, FIG. 4B, immediately following the moment t4 of FIG. 4A. The other input of this fourth AND gate is connected to receive the output from the reverse motion detector 52.

The operation of the reverse motion detector 52 will be best understood from a comparison of FIGS. 4A and 4B. The signal waveforms in the latter figure are plotted on the assumption that the coin has been reversed in the chute 10, with the output from the upper photodetector 22 going high after the output from the lower photodetector 24 has gone high. The reverse motion detector is so constructed that its output goes low when, as in FIG. 4A, the output from the lower photodetector 24 goes high after the output from the upper photodetector 22 has gone high. Conversely, when the output from the upper photodetector 22 goes high after the output from the lower photodetector 24 has gone high, as in FIG. 4B, then the output from the reverse motion detector 52 goes high.

An assembly of a RS flip-flop circuit and two oneshot multivibrators which are respectively coupled to the R terminal and S terminal of the RS flip-flop circuit can be used as the reverse motion detector 52.

Thus the pulse produced by the sensing circuit 46 at the moment t5 does not pass the fourth AND gate 38 if the coin C has traveled down the chute 10 without being reversed. However, should the coin be reversed, the output pulse of the sensing circuit 46 will pass the fourth AND gate 38, as is apparent from a consideration of FIG. 4B. The pulse that has passed the fourth AND gate is applied as the REVERSE MOTION signal to the control circuitry of the coin operated machine, possibly resulting in the locking of its operation and/or in the production of an alarm.

THIRD FORM

Figure 5:
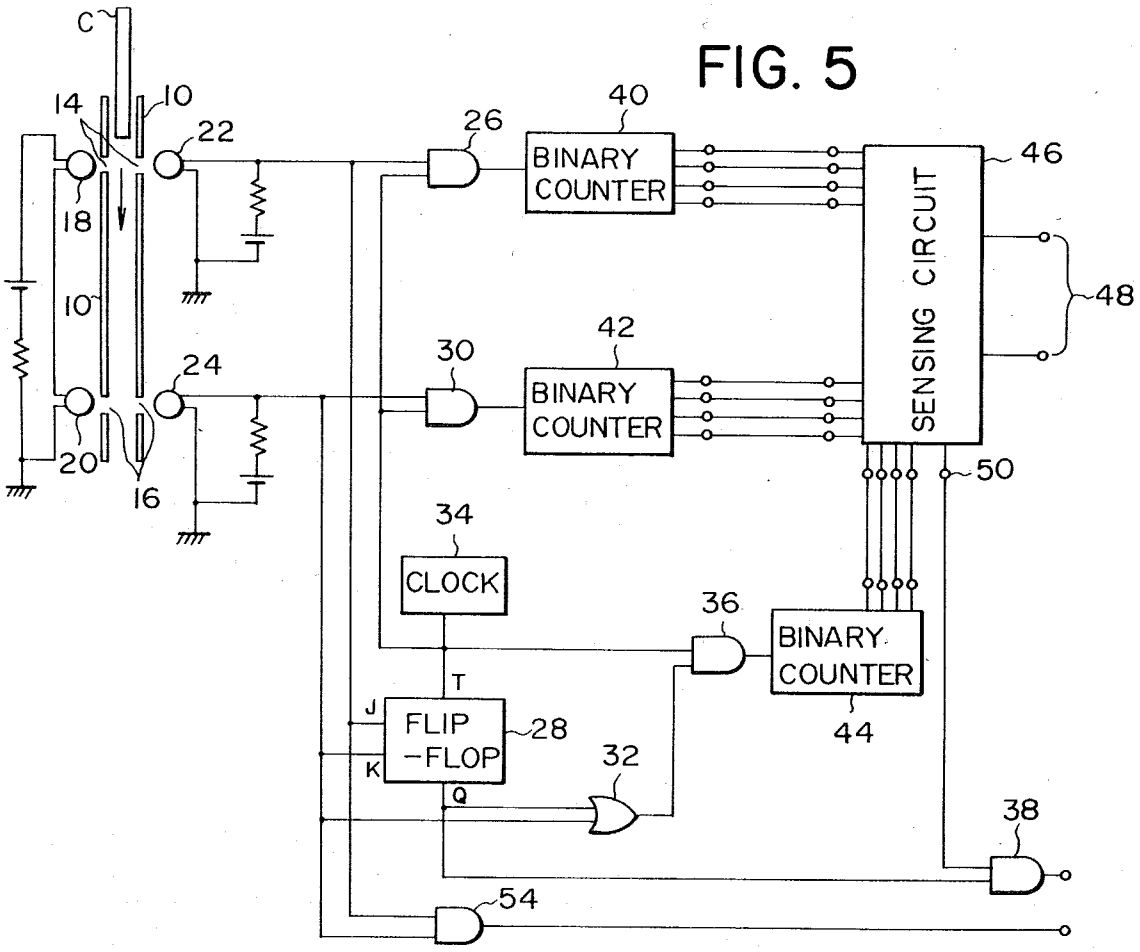
FIG. 5 is a block diagram of a third preferred form of the coin entry sensing system in accordance with the invention, the sensing system being herein shown further equipped to detect oversize coins.

In FIG. 5 is shown still another preferred form of the coin entry sensing system in accordance with the invention. This system is analogous in configuration with that of FIG. 1 except for provisions for sensing the size of each inserted coin. Any coin having a diameter greater than that of the requisite coin can be automatically rejected.

Toward the above objective, in the FIG. 5 system, the spacing between the upper 14 and lower 16 pairs of apertures in the chute 10 is made only slightly more than the diameter of the proper coin to be accepted by the machine. Another difference of this system from the FIG. 1 embodiment is a fifth AND gate 54 having two inputs coupled directly to the respective photodetectors 22 and 24. This AND gate functions to determine if the inserted coin has a diameter not more than the predetermined limit.

The other details of construction can be exactly as set forth in conjunction with the FIG. 1 embodiment. The various other parts of this third embodiment are therefore indicated by the same reference numerals as used to denote the corresponding parts of the first embodiment.

OPERATION OF THIRD FORM

Figure 6A:
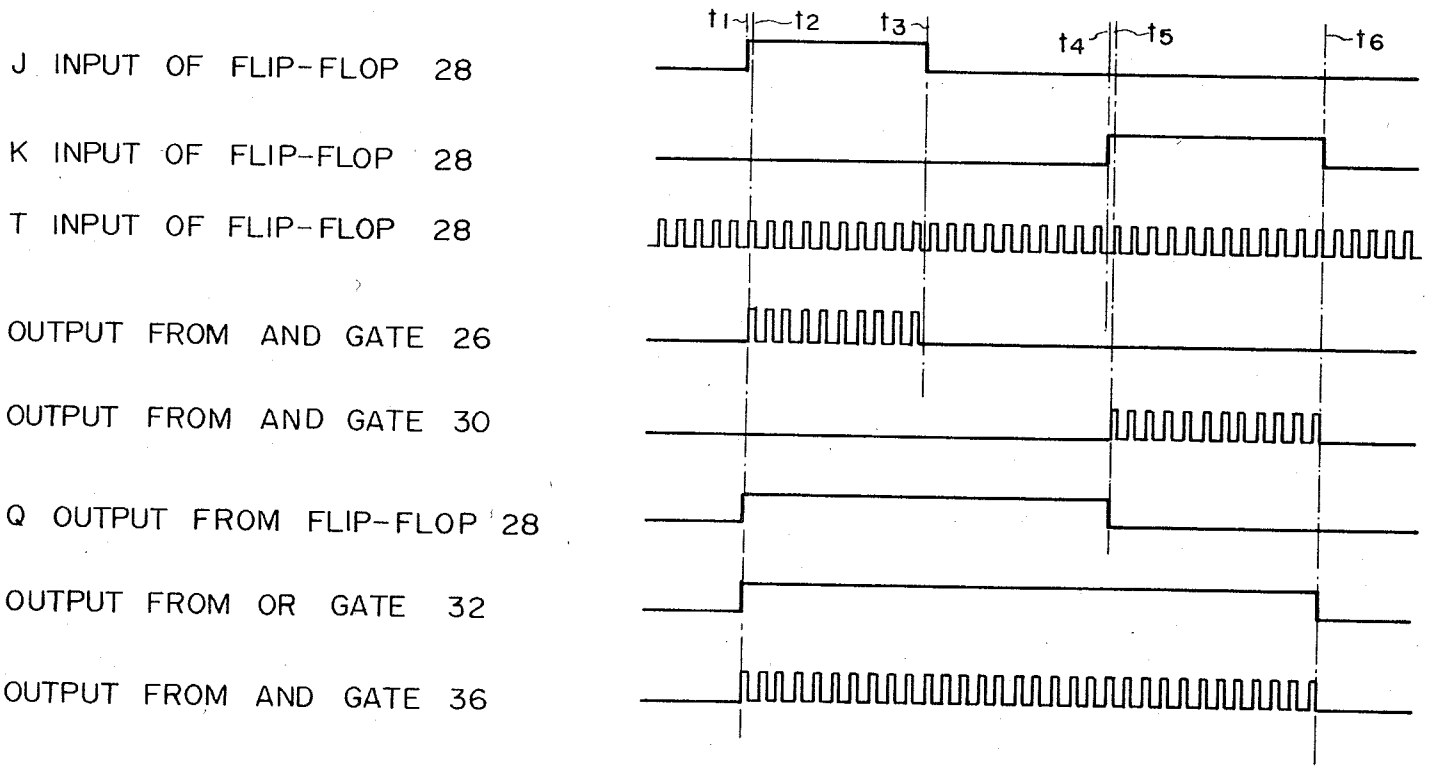
FIG. 6A is a waveform diagram showing signals appearing in various parts of the FIG. 5 system upon proper insertion of a coin.
Figure 6B:
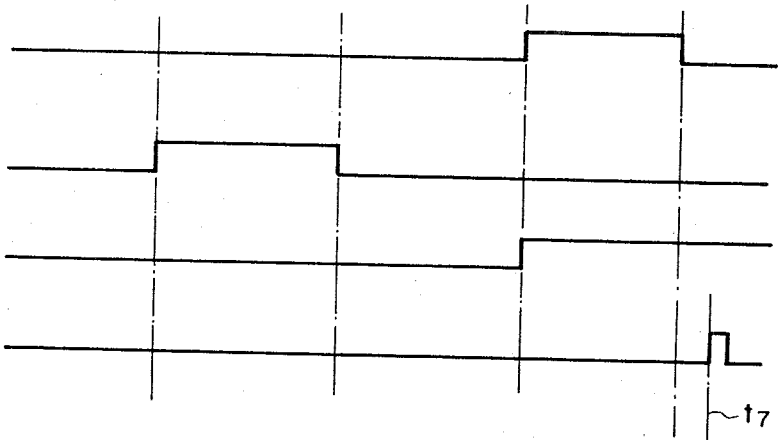
FIG. 6B is a waveform diagram showing signals appearing in various parts of the FIG. 5 system when a coin is reversed as by stringing.

FIG. 6A depicts the signal waveforms appearing in the various parts of the FIG. 5 system when a coin of proper size has fallen properly through the chute 10. FIG. 6B plots some pertinent waveforms when a coin of proper size has been reversed in the chute 10. An inspection of these figures will make it clear that the FIG. 5 system operates just like that of FIG. 1 for sensing the timely travel of the coin through the chute 10 and the possible reverse motion of the coin in the chute. Thus the OUT OF TIME signal is produced from the output terminals 48 of the sensing circuit 46, and the REVERSE MOTION signal from the fourth AND gate 38. Reference is directed to the operational description of the first embodiment for more detailed discussion of the way the OUT OF TIME and REVERSE MOTION signals are produced.

It will be understood from FIG. 6A that the lower photodetector 24 goes high only after the upper photodetector 22 has gone low when a coin of a proper diameter, as well as that of less than the proper diameter, falls through the chute 10. Having only one input energized at one time, the fifth AND gate 54 delivers no output upon insertion of coins having diameters not exceeding the spacing between the upper 14 and lower 16 pairs of apertures in the chute 10.

Figure 6C:
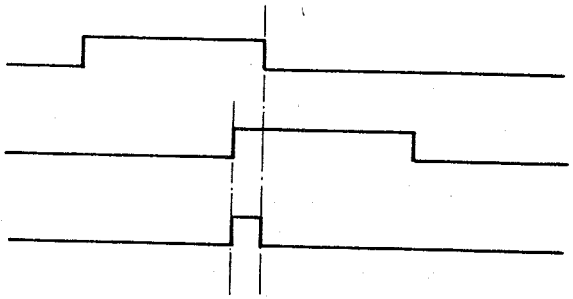
FIG. 6C is a waveform diagram showing signals appearing in various parts of the FIG. 5 system upon insertion of an oversize coin.

FIG. 6C represents the waveforms of some pertinent signals appearing when a coin having a diameter greater than the spacing between the two pairs of apertures in the chute has fallen therethrough. Such an oversize coin can simultaneously block the light beams from the upper 18 and lower 20 light sources. The resulting high outputs from both photodetectors 22 and 24, as indicated in this figure, make the output from the fifth AND gate 54 go high. This high output is delivered as the OVERSIZE signal to the control circuitry of the coin operated machine, possibly causing the same to reject the oversize coin.

FOURTH FORM

Figure 7:
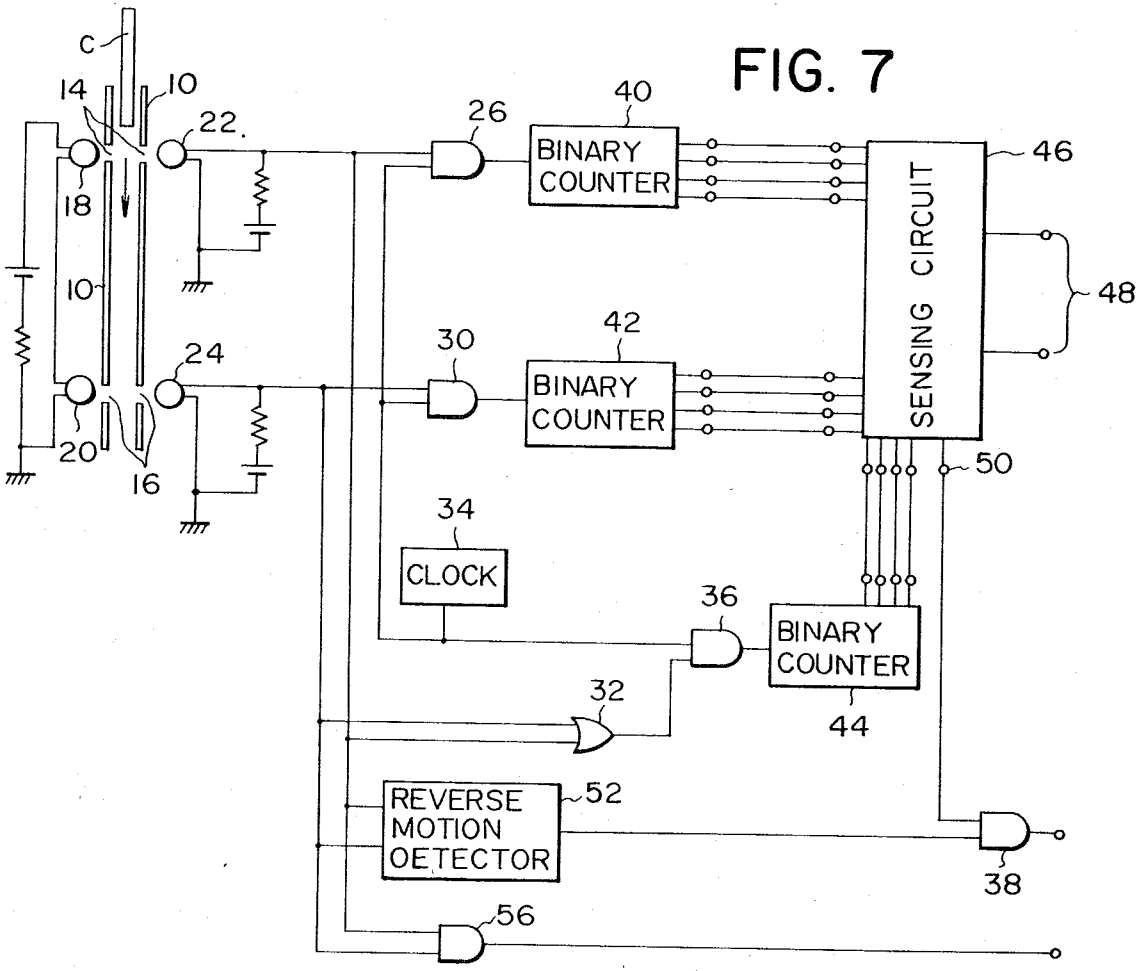
FIG. 7 is a block diagram of a fourth preferred form of the coin entry sensing system in accordance with the invention, the sensing system being herein shown further adapted for the detection of undersize coins.

FIG. 7 illustrates a further preferred form of the coin entry sensing system in accordance with the invention. This system is akin to the FIG. 3 system except that the former additionally comprises facilities for the detection of undersize coins.

For the detection of undersize coins the spacing between the upper 14 and lower 16 pairs of apertures in the chute 10 is made only slightly less than the diameter of the valid coin to be accepted by the machine. Further provided to the same end is an AND gate 56, in addition to the four AND gates 26, 30, 36 and 38 used in this embodiment, which has its two inputs coupled to the respective photodetectors 22 and 24. The other details of organization are exactly as set forth previously with reference to FIG. 3. The various other parts of the FIG. 7 system are therefore designated by the same reference numerals as used to denote the corresponding parts of the FIG. 3 system.

OPERATION OF FOURTH FORM

The coin entry sensing system of FIG. 7 operates just like the FIG. 3 system for the production of the OUT OF TIME and REVERSE MOTION signals. No description of operation will therefore be necessary as far as such signals are concerned.

Figure 8A:
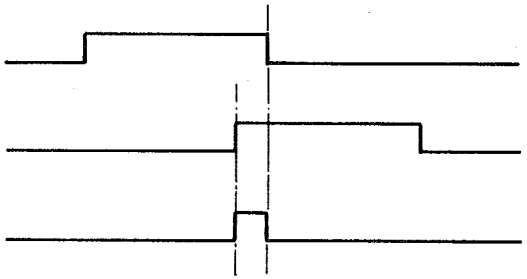
FIG. 8A is a waveform diagram showing signals appearing in various parts of the FIG. 7 system upon insertion of a proper size coin.
Figure 8B:
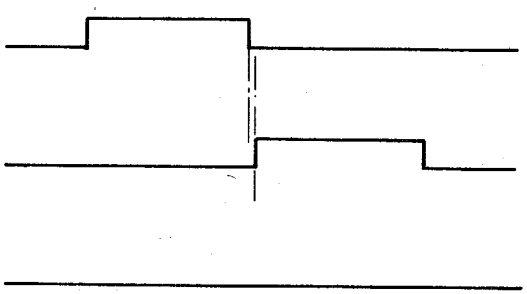
FIG. 8B is a waveform diagram showing signals appearing in various parts of the FIG. 7 system upon insertion of an undersize coin.

Having a diameter in excess of the spacing between the upper 14 and lower 16 pairs of apertures in the chute 10, a proper size coin can simultaneously intercept the light beams from the two light sources 18 and 20. The consequent high outputs from both photodetectors 22 and 24 cause the output from the fifth AND gate 56 to go high, as represented in FIG. 8A. However, any undersize coin can shield only one photodetector from the associated light beam at one time, resulting in the production of no output pulse from the fifth AND gate 56, as depicted in FIG. 8B. The control circuitry of the coin operated machine responds to each output pulse from the fifth AND gate 56 for causing the machine to operate in an intended manner. In the absence of such a pulse the machine will not operate, and the undersize coin may be rejected.

It is to be understood that the above disclosed embodiments are by way of example only and are not intended to impose limitations upon the invention. The inventive concepts may be embodied in other forms without departing from the scope of the invention. For example, with a slight modification of the illustrated embodiments, coins having central holes may be easily detected.

What is claimed is:

1. A coin entry sensing system for a coin operated machine, comprising:

(a) guide means defining a guideway for a deposited coin, the guide means having first and second pairs of opposed apertures spaced from each other in the longitudinal direction of the guideway;

(b) first and second light sources disposed exteriorly of the guide means;

(c) first and second photodetectors disposed exteriorly of the guide means and adapted to be normally irradiated respectively by the first and second light sources through the first and second pairs of apertures in the guide means, the deposited coin preventing the light sources from irradiating the photodetectors when traveling through the guideway past the apertures;

(d) a pulse generator for outputting clock pulses;

(e) first measuring means for measuring the period of time required for the coin to pass the first pair of apertures in the guide means, the first measuring means comprising first gate means coupled to the first photodetector and the pulse generator for selectively passing output pulses from the pulse generator and first counter means for counting the pulses that have passed the first gate means;

(f) second measuring means for measuring the period of time required for the coin to pass the second pair of apertures in the guide means, the second measuring means comprising second gate means coupled to the second photodetectors and a pulse generator for selectively passing out pulses from the pulse generator and second counter means for counting the pulses that have passed the second gate means;

(g) third measuring means responsive to both first and second photodetectors for measuring the period of time from the moment the coin starts passing the first pair of apertures to the moment the coin completes passing the second pair of apertures, the third measuring means comprising holding means for holding a signal output at the moment the coin starts passing the first pair of apertures until the moment the coin completes passing the second pair of apertures, third gate means coupled to the holding means and the post generator for selectively passing output pulses from the pulse generator, and third counter means for counting the pulses that pass the third gate means;

(h) sensing means responsive to the first, second and third measuring means for sensing whether the third measuring means for sensing whether the three measured periods of time are within predetermined limits respectively; and (i) reverse motion detecting means responsive to the first and second photodetectors for detecting a reverse travel of the coin through the guideway.

2. The coin entry sensing system of claim 1, wherein the holding means of the third measuring means comprises bistable circuit means responsive to the first and second photodetectors and OR gate means coupled to the bistable circuit means and the second photodetector, the bistable circuit functioning as a part of the reverse motion detecting means as well as the holding means.

3. The coin entry sensing system of claim 2 wherein the output from the bistable circuit means goes high or low depending upon whether the deposited coin has travelled from the first to the second pair of apertures or from the second to the first pair of apertures in the guide means, and wherein the reverse motion detecting means further comprises gate means coupled to the bistable circuit and a sensing means for selectively passing an output from the bistable circuit means.

4. The coin entry sensing system of claim 1, wherein the spacing between the first and second pairs of apertures in the guide means is less than the diameter of the coin to be accepted by a coin operated machine, the holding means for the third measuring means comprising OR gate means coupled to the first and second photodetectors, the reverse motion detecting means comprising a reverse motion detector coupled to the first and second photodetectors and gate means coupled to the reverse motion detector and a sensing circuit for selectively passing outputs from the sensing means.

5. The coin entry sensing system of claim 4, further comprising undersized detecting means responsive to the first and second photodetectors for detecting a coin and having a diameter less than that of a proper coin to be accepted by the coin operated machine, the undersized detecting means having gate means providing a high output when a proper sized coin simultaneously intercepts the light means emitted by the first and second light sources.

6. The coin entry sensing system of claim 2, wherein the spacing between the first and second pairs of apertures in the guide means is greater than the diameter of a proper coin, and further comprising oversized detecting means responsive to the first and second photodetectors for detecting a coin having an diameter greater than that of the proper coin to be accepted by the coin operated machine, the oversized detecting means having gate means providing a high output when an oversized coin simultaneously intercepts the light beams emitted from the first and second light sources.

* * * * *